US007497028B2

(12) United States Patent
Nevers et al.

(10) Patent No.: US 7,497,028 B2
(45) Date of Patent: Mar. 3, 2009

(54) PICTURE HANGER ASSEMBLY AND METHOD

(75) Inventors: Joseph G. Nevers, Wilmington, NC (US); Benjamin W. Paharik, Hopkinton, MA (US)

(73) Assignee: Picture Perfect, LLC, Wilmington, DE (US)

( * ) Notice: Subject to any disclaimer, the term of this patent is extended or adjusted under 35 U.S.C. 154(b) by 375 days.

(21) Appl. No.: 11/529,917

(22) Filed: Sep. 29, 2006

(65) Prior Publication Data

US 2008/0078916 A1 Apr. 3, 2008

(51) Int. Cl.
*B25H 7/00* (2006.01)

(52) U.S. Cl. ..... 33/613; 33/666

(58) Field of Classification Search ..... 33/316, 33/645, 666, 669

See application file for complete search history.

(56) References Cited

U.S. PATENT DOCUMENTS

| | | | | |
|---|---|---|---|---|
| 4,382,337 | A * | 5/1983 | Bendick | 33/574 |
| 4,611,780 | A | 9/1986 | Robertson | |
| 4,837,942 | A | 6/1989 | Watts | |
| 5,141,300 | A | 8/1992 | Ciesla | |
| 5,398,906 | A | 3/1995 | Aydelott | |
| 5,533,288 | A | 7/1996 | Lambert | |
| 6,574,880 | B2 * | 6/2003 | Lombardo | 33/666 |
| 6,952,887 | B2 | 10/2005 | Muchnik | |
| 6,961,046 | B2 | 11/2005 | Bowden, III et al. | |
| 7,185,442 | B2 * | 3/2007 | Grillo | 33/613 |
| 7,234,245 | B2 * | 6/2007 | Tatum | 33/666 |
| 7,275,334 | B2 * | 10/2007 | Horst | 33/666 |
| 2002/0066199 | A1 * | 6/2002 | Hanson | 33/613 |
| 2004/0098875 | A1 * | 5/2004 | Gould | 33/613 |
| 2007/0283588 | A1 * | 12/2007 | Gardner et al. | 33/666 |

* cited by examiner

*Primary Examiner*—Christopher W Fulton
(74) *Attorney, Agent, or Firm*—Lowrie, Lando & Anastasi, LLP

(57) ABSTRACT

A support assembly is configured to secure an object to a structure and includes a bracket adapted to be secured to the object. The bracket has an opening formed therein. The support assembly further includes a support capable of being received within the opening of the bracket in a secure position. The support has a marking element designed to extend away from the object when positioning the support within the opening of the bracket. The arrangement is such that when positioning the support within the opening of the bracket, the marking element forms a mark on the structure in response to positioning the object against the structure. The support assembly also includes a device to secure the support to the structure upon removing the support from the opening of the bracket with the marking element being positioned on the mark formed on the structure. The support secures the object to the structure upon positioning the object on the support in a position in which the support is received within the opening of the bracket. Methods of securing an object to a structure are further disclosed.

38 Claims, 15 Drawing Sheets

PICTURE HANGER ASSEMBLY AND METHOD

BACKGROUND OF THE INVENTION

1. Field of the Invention

This invention relates generally to devices used to secure an object to a structure, and more particularly to devices and methods for hanging a picture frame or similar object, such as but not limited to a mirror, a photo, or wall décor, onto a wall or some other vertical surface.

2. Discussion of Related Art

Picture frames, mirrors and related articles, such as light-duty shelving, intended for display on a wall are typically provided with some type of support for mounting or otherwise suspending the article from a support component, such as a nail or support hanger, that is secured to the wall. Picture frames are commonly provided with one of two types of supports. One type of support is a wire or cord that is attached at opposite sides of the picture frame. Another type of support is a saw-tooth bracket that is attached to the back of the top or near the top of the picture frame. With the saw-tooth bracket, the picture frame is suspended by a wall mounted nail, for example.

With both types of supports, the support is located at the back of the picture frame and therefore is substantially out of the sight of the person mounting the picture frame on the wall. Thus, it is somewhat difficult to determine precisely where to install the nail or the support component so that once the picture frame is hung, the picture frame is located exactly where the installer intended to position the picture frame. The person installing the picture frame must resort to trial and error or measuring and calculating where to position the picture frame in an exact location. This trial and error approach may be further complicated by larger picture frames, which are bulky and difficult to handle.

Various types of positioning and securing devices are known. Reference may be made to U.S. Pat. No. 4,611,780 to Robertson, U.S. Pat. No. 4,837,942 to Watts, U.S. Pat. No. 5,141,300 to Ciesla, U.S. Pat. No. 5,398,906 to Aydelott, U.S. Pat. No. 5,533,288 to Lambert, U.S. Pat. No. 6,952,887 to Muchnik and U.S. Pat. No. 6,961,046 to Bowden, III. et al., as well as to U.K. Patent No. 228921 to Springlock, as examples of devices used to mount a picture frame onto a wall.

SUMMARY OF THE INVENTION

An aspect of the invention is directed to a support assembly configured to secure an object to a structure. In a certain embodiment, the support assembly comprises a bracket adapted to be secured to the object. The bracket may have an opening formed therein. The support assembly may further comprise a support adapted to be received within the opening of the bracket in a secure position. The support may have a marking element designed to extend away from the object when positioning the support within the opening of the bracket. The arrangement is such that when positioning the support within the opening of the bracket, the marking element is adapted to form a mark on the structure in response to positioning the object against the structure. The support assembly may also comprise a device adapted to secure the support to the structure upon removing the support from the opening of the bracket with the marking element being positioned on the mark formed on the structure. The support secures the object to the structure upon positioning the object on the support in a position in which the support is received within the opening of the bracket.

Embodiments of the support assembly may include the support further having a base having opposite sides, with the marking element extending from one side of the base. The support may further have a head portion extending from an other side of the base, with the head portion being adapted to be received within the opening of the bracket. The opening of the bracket may be configured to have a first portion configured to receive the head portion and a second portion in communication with the first portion configured to receive a neck portion of the support therein when positioning the support within the opening. The bracket may have at least one tab adapted to secure the bracket to the object. The bracket may further have a main body having the opening, the main body and the at least one tab defining a space between the bracket and the object when securing the bracket to the object. The head portion of the support may have a surface and an aperture extending from the surface through the base for receiving the device therein. In a certain embodiment, the device may comprise a nail that is sized to be received within the aperture. The marking element may comprise a projection having a pointed tip. In other embodiments, the support system may further comprise a leveling device adapted to be placed on the object to indicate an orientation of the object. The support system may further comprise a fastener configured to replace the support and to mount on the structure to secure the bracket to the structure. In one embodiment, the fastener comprises a T head screw fastener.

Another aspect of the invention is directed to a method of securing an object to a structure. In one embodiment, the method comprises securing a bracket to the object; releasably securing a support to the bracket, the support having a marking element designed to extend away from the object; positioning the object against the structure; applying a force on the object against the structure so as to form a mark on the structure with the marking element; removing the support from the bracket; securing the support to the structure with the marking element being positioned on the mark formed on the structure; and securing the object to the structure by securing the bracket to the support.

Embodiments of the method may further include securing the support to the bracket by positioning the support within an opening formed in the bracket. Securing the object to the structure may comprise positioning the support within the opening of the bracket. In a certain embodiment, the marking element is a projection having a pointed tip, and wherein the mark is an indent formed on the structure. Securing the support to the structure may comprise seating the projection within the indent. The method may also comprise leveling the object prior to applying a force on the object. In another embodiment, the method may comprise replacing the support with a fastener, and rotating the fastener with respect to the bracket.

A further aspect of the invention is directed to a kit for securing an object to a structure. In one embodiment, the kit comprises a first support element adapted to be secured to the object and a second support element adapted to be secured to the first support element. The second support element may have a marking element designed to extend away from the object when securing the second support element to the first support element. The arrangement is such that when securing the second support element to the first support element, the marking element is adapted to form a mark on the structure at a desired location on the structure in response to a force applied on the object. The kit may further comprise a device adapted to secure the second support element to the structure upon removing the second support element from the first support element with the marking element being positioned on the mark formed on the structure. The second support element secures the object to the structure upon positioning the object on the second support element.

Embodiments of the kit may include the first support element configured as a bracket and the second support element as a support. In one embodiment, the device comprises a nail. The object may be a picture frame and the structure may be a wall. The kit may further comprise a leveling device adapted to be placed on the object to indicate an orientation of the object. The kit may further comprise a third support element configured to replace the second support element to provide tamper-proof attachment to the first support element. The kit may further comprise a tool to rotate the third support element.

Yet another aspect of the invention is directed to a support assembly configured to secure an object to a structure. The support assembly may comprise a bracket adapted to be secured to the object and a support adapted to be releasably secured to the bracket. The support has a marking element designed to extend away from the object when releasably securing the support to the bracket. The arrangement is such that when releasably securing the support to the bracket, the marking element is adapted to form a mark on the structure on the structure in response to positioning the object against the structure. The support assembly further comprises a device adapted to secure the support to the structure upon removing the support from the opening of the bracket with the marking element being positioned on the mark formed on the structure. The support secures the object to the structure upon positioning the object on the support in a position in which the support is releasably secured to the bracket.

Embodiments of the support assembly may include configuring the bracket with an opening formed therein configured to receive the support in a releasably secure position. The support further has a base having opposite sides, with the marking element extending from one side of the base. The support further has a bulbous head extending from an other side of the base, with the bulbous head being adapted to be received within the opening of the bracket. The opening of the bracket may be configured to have a first portion configured to receive the bulbous head and a second portion in communication with the first portion configured to receive a neck of the bulbous head therein when positioning the support within the opening. The bracket may have at least one tab adapted to secure the bracket to the object. The bracket may further have a main body having the opening, the main body defining a space between the bracket and the object when securing the bracket to the object. The bulbous head of the support may have a surface and an aperture extending from the surface through the base, the aperture being configured to receive the device therein. In one embodiment, the object is a picture frame and the structure is a wall. The support system may further comprise a leveling device adapted to be placed on the object to indicate an orientation of the object.

Another aspect of the invention is directed to a method of securing an object to a structure. In a certain embodiment, the method comprises: securing a first support element to the object; releasably securing a second support element to the first support element, the second support element having a projection designed to extend away from the object; positioning the object against the structure; applying a force on the object so as to form an indent on the structure with the projection of the second support element; removing the second support element from the first support element; seating the projection of the second support element within the indent of the structure; securing the second support element to the structure; and securing the object to the structure by securing the first support element to the second support element. One embodiment of the method may further comprise replacing the support with a fastener, and rotating the fastener with respect to the bracket.

DESCRIPTION OF THE DRAWINGS

For a better understanding of the present invention, reference is made to the drawing figures which are incorporated herein by reference and in which.

DETAILED DESCRIPTION OF THE INVENTION

Figure 2:
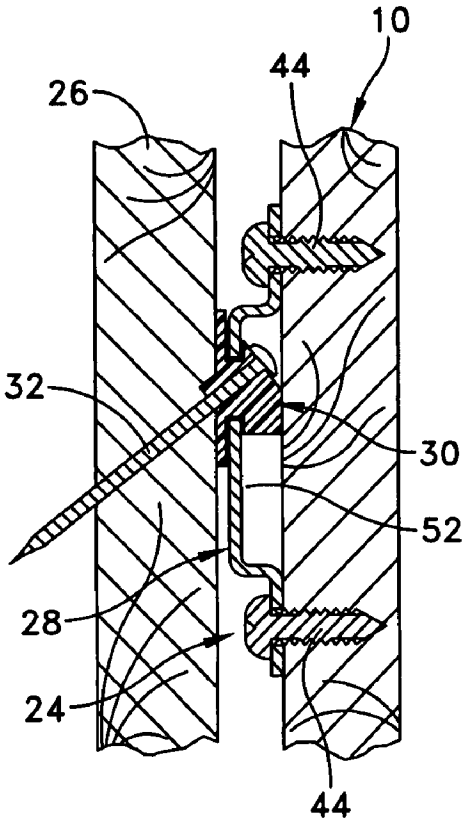
FIG. 2 is a cross-sectional view of the picture frame secured to a wall with one of the support assemblies shown in FIG. 1.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing,"

"involving," and variations thereof herein, is meant to encompass the items listed thereafter and equivalents thereof as well as additional items.

Picture frames, wall décor, photos, mirrors, light-duty shelving, and any other object or article that is mounted on or secured to a surface, such as a vertical wall, as mentioned above, present challenges to the person installing the object to position the object in an exact location. The support assemblies and methods of embodiments of the invention are directed to assisting the installer in positioning and locating the objects, such as a picture frame, at an exact, level location. Specifically, embodiments of the invention may include a support assembly in the form of a kit that is provided either with the object to be hung, such as a picture frame, or may be purchased separately from the object. The components of the kit may be installed pursuant to methods of the invention disclosed herein. The support assemblies are easy to install and affordable to purchase.

Figure 1:
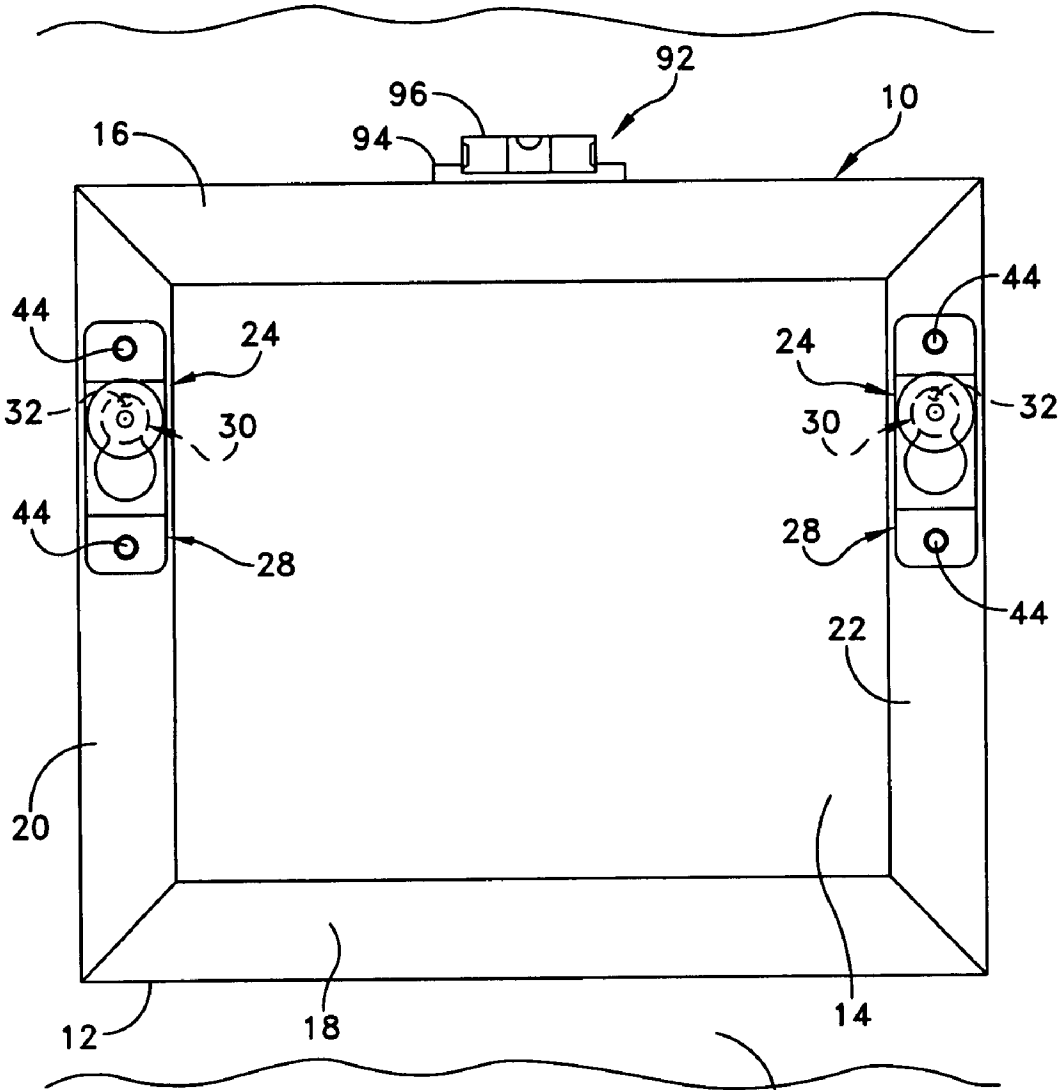
FIG. 1 is a rear view of a picture frame having two support assemblies of an embodiment of the invention.

With reference to FIG. 1, generally indicated at 10 is a typically-constructed picture frame having an outer frame 12, which forms a boundary defining an interior region 14 that may be configured to receive a picture or any other item to be disposed within and displayed by the frame. As shown, the picture frame 10 may be rectangular in construction; however, it should be understood by those skilled in the art that the principles of the invention disclosed herein may be applied to any shaped object and that the provision of a rectangular picture frame is for illustration purposes only. For example, the picture frame may take the form of a square, a circle, an oval, or any other type of geometric or unusual shape. The frame 12 of the picture frame 10 illustrated in FIG. 1 may include a top horizontal rail member 16, a bottom horizontal rail member 18, left-hand vertical rail member 20, and a right-hand vertical rail member 22. The rail members 16, 18, 20 and 22 may be connected to one another in any suitable manner.

Still referring to FIG. 1, two support assemblies, each generally indicated at 24, are provided for mounting or otherwise securing an object, such as picture frame 10, onto a structure, such as a wall 26. As shown, a support assembly 24 may be provided on both vertical rail members 20, 22 for supporting or otherwise suspending the picture frame 10 from the wall 26. As discussed above, the support assembly 24 of embodiments of the invention may be suited for supporting an object on any type of generally vertical surface. In addition, although two support assemblies 24 are illustrated in FIG. 1, a person skilled in the art, given the benefit of this disclosure, may employ only one such support assembly 24 to support the picture frame. Specifically, a single support assembly 24 may be secured to the top horizontal rail member 16 centrally on the rail member for supporting the picture frame 10 on the wall 26.

With continued reference to FIG. 1, and additional reference to FIG. 2, each support assembly may include a bracket, generally indicated at 28, a support/marker member, generally indicated at 30, and a securing element 32. These components of the support assembly 24 may be configured to operate with one another, pursuant to methods of the invention discussed below, to secure the picture frame 10 in an exact location on the wall 26. In addition, as will become evident below, the support assembly 24 may include other components to ensure that the picture frame 10 is mounted level with respect to a generally horizontal plane.

Figure 4:
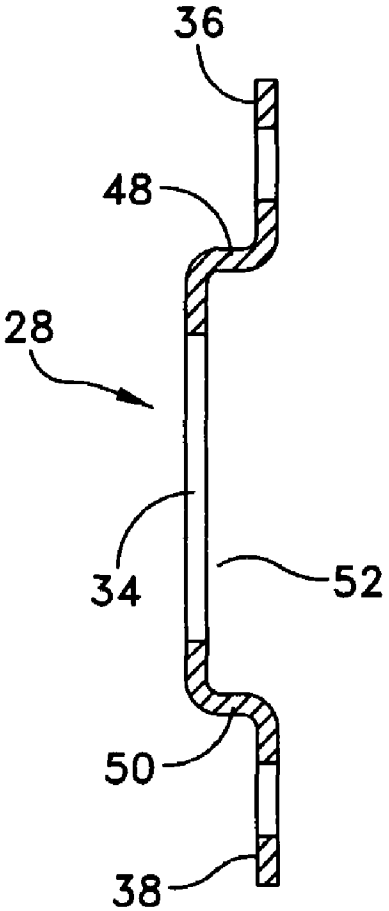
FIG. 4 is a cross-sectional view of the bracket taken along line 4-4 of FIG. 3.
Figure 3:
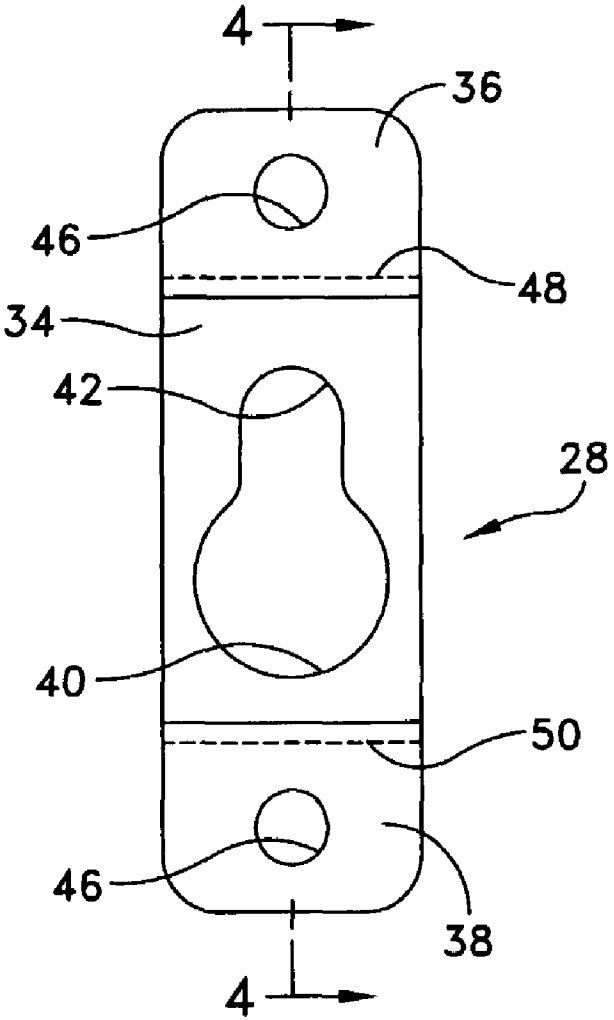
FIG. 3 is an elevational view of a bracket of the support assembly of an embodiment of the invention.

Referring additionally to FIGS. 3 and 4, the bracket 28, in one embodiment of the invention, may be fabricated from stamped metal, such as cold rolled steel. Other materials may be used, such as other types of steels, metal alloys, rigid plastics and the like, which are suitable to support the picture frame or any other object requiring support. The metal bracket 28 may also be fabricated from plastic, or may be coated with a polymeric material, such as vinyl or some other scratch-resistant material, to prevent scratching of the wall surface and any other object the metal bracket may contact. The provision of cold rolled steel is to provide a solid support for suspending heavier objects. The bracket 28 may include a main body 34 and a pair of tabs with one tab 36 provided at the top of the main body and another tab 38 provided at the bottom of the main body. As shown best in FIGS. 3 and 4, the main body includes a keyhole-shaped opening with relatively large, centrally located opening 40 having a slot portion 42 in communication with the opening 40. The purpose of the large opening 40 and slot portion 42 will become apparent as the description proceeds. However, it should be understood by those skilled in the art that are given the benefit of this disclosure that the keyhole-shaped opening may be shaped differently and still fall within the scope of the present invention.

The tabs 36, 38 are provided for securing the bracket 28 to the frame 12 of the picture frame 10 by a suitable fastener. As illustrated in FIGS. 1 and 2, screw fasteners, each indicated at 44, or nails or other types of fasteners, may be employed for securing the each bracket 28 to the frame 12 of the picture frame 10. However, any type of fastener, such as a nail, may be chosen by the person installing the support assembly 24. As shown in FIGS. 3 and 4, suitably sized openings, each indicated at 46, are formed in the tabs 36, 38 of the bracket 28 to receive the screw fasteners 44 therein. In a certain embodiment, the tabs 36, 38 have bent portions 48, 50, respectively, formed therein so that the tabs 36, 38 extend along a plane that is offset from the plane of the main body 34 to create a space 52 (FIG. 4) between the main body and the frame 12 of the picture frame 12, the purpose of which will become evident as the description of the support assembly 24 proceeds. FIG. 2 further illustrates the space 52 between the main body 34 of the bracket 28 and the surface of the rail member 22 of the frame 12 of the picture frame 10. The bent portions 48, 50 that create the 52 space may extend a suitable length so as to accommodate the support/marker member 30 within the space 52 without interference.

Figure 6:
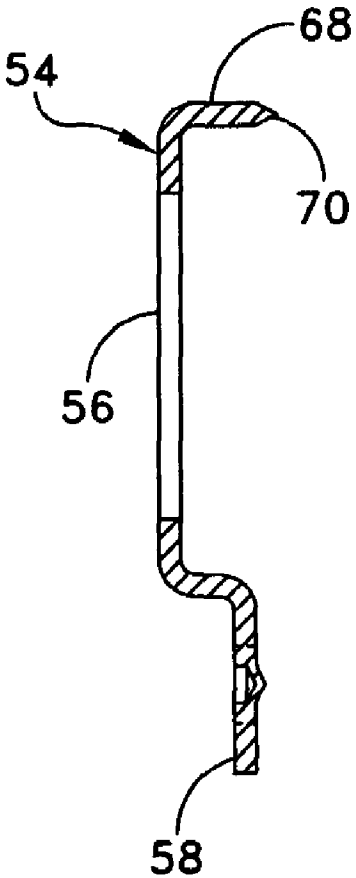
FIG. 6 is a cross-sectional view of the bracket taken along line 6-6 of FIG. 5.
Figure 5:
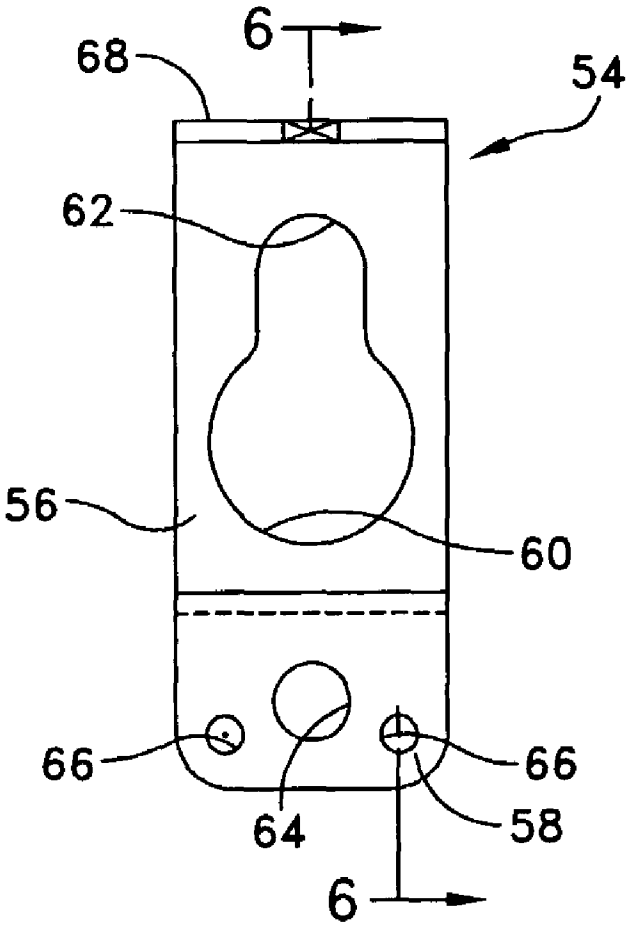
FIG. 5 is an elevational view of a bracket of the support assembly of another embodiment of the invention.

FIGS. 5 and 6 illustrate a bracket, generally indicated at 54, of another embodiment of the invention. As shown, the bracket 54 may include a main body 56 and a single tab 58 provided at the bottom of the main body 56. Obviously, the tab 58 may be provided at the top of the main body 56 of the bracket 54 by simply rotating the bracket one hundred and eighty degrees. As with bracket 28, bracket 54 may be configured with a keyhole-shaped opening defined by a large opening 60 and slot portion 62. The tab 58 may be configured with a single opening 64 sized to receive a fastener, such as screw fastener 44, and two dimples, each indicated at 66, disposed next to the opening 64 for preventing the rotation of the bracket 54 once the bracket is mounted onto the frame 12 of the picture frame 10. Specifically, the dimples 66 engage the frame 12 of the picture frame 10 when securing the screw fastener 44. Alternatively, in place of the dimples 66, two smaller openings may be provided for receiving small nails that are driven into the frame 12 of the picture frame 10. It should be understood that only one dimple 66 may be provided to achieve the prevention of the rotation of the bracket 54. Disposed at the other end of the main body 56 is a bent portion 68 having a pointed or barbed edge 70 that is adapted to engage the rail member (20 or 22 in FIG. 1) of the frame 12 of the picture frame 10 after mounting the bracket 54 to the rail member in the manner described above.

Figure 8:
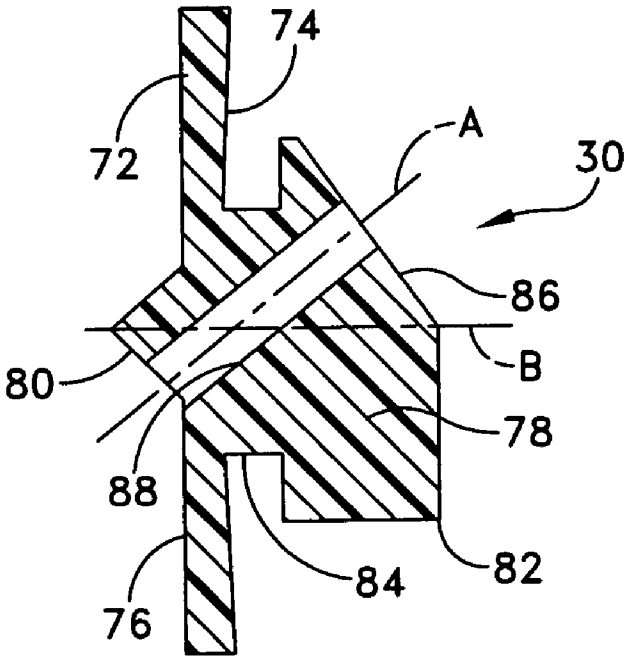
FIG. 8 is a cross-sectional view taken along line 8-8 of FIG. 7.
Figure 7:
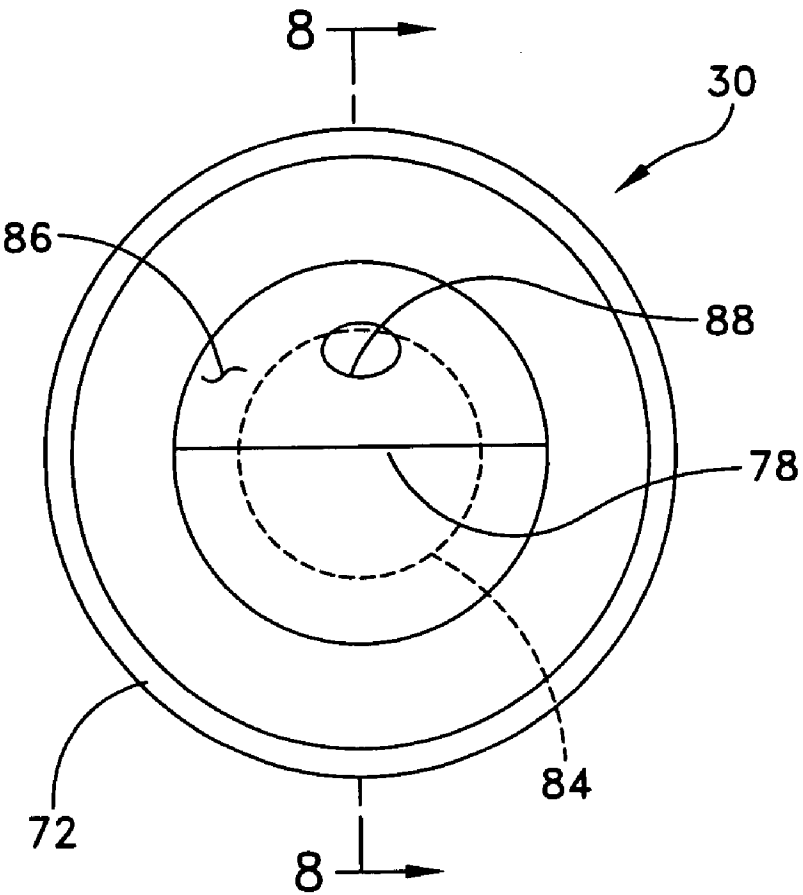
FIG. 7 is a front view of a support of the support assembly of an embodiment of the invention.
Figure 9:
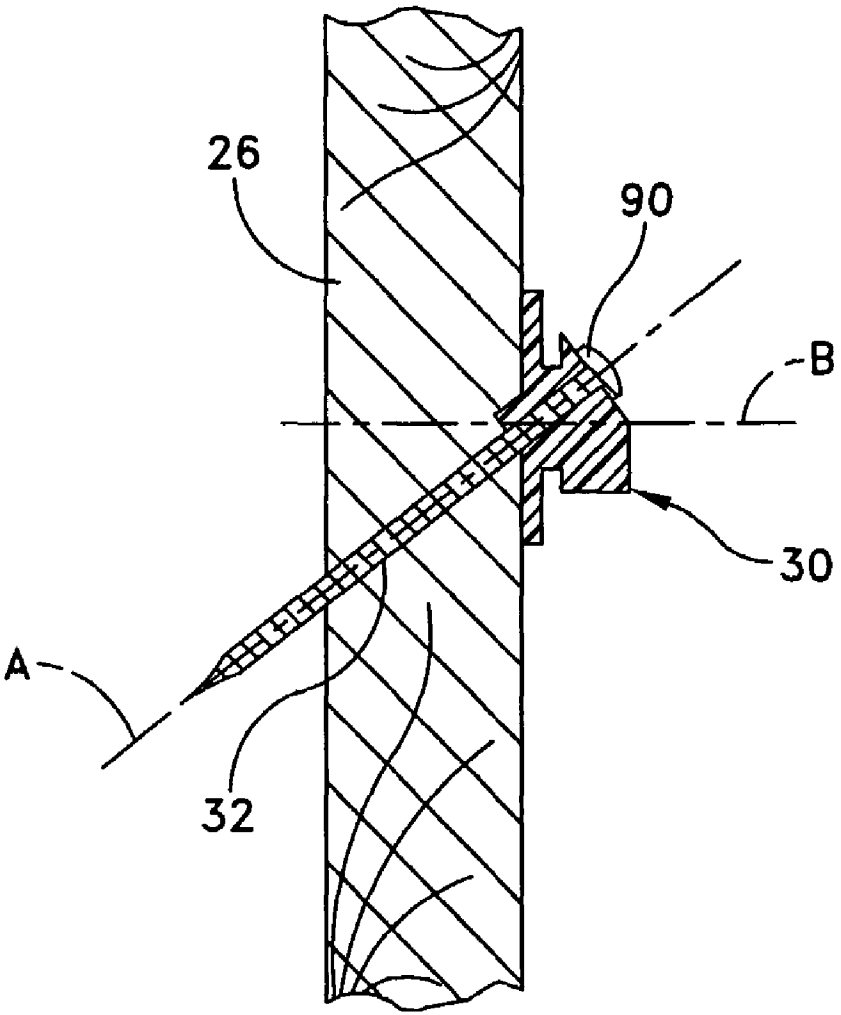
FIG. 9 is a cross-sectional view of a support of the support assembly secured to a wall.

Turning now to FIGS. 7-9, the support/marker member 30 may be fabricated from plastic material, such as nylon or other plastic or composite materials. In a certain embodiment, the support/marker member 30 may include a base 72 having opposite sides 74, 76, a bulbous head 78 extending from one side 72 of the base and a marking element in the form of a cone-shaped projection 80 having a pointed tip extending from the other side 76 of the base. As best viewed in FIG. 8, the bulbous head 78 includes a head portion 82 and a neck portion 84 having a diameter less than the head portion. The arrangement is such that the support/marker member 30 may be releasably secured to the bracket 28 by simply inserting the head portion 82 of the bulbous head 78 into the large opening 40 and sliding the neck portion 84 of the bulbous head into the slot portion 42. The diameter of the neck portion 84 may be sized so that there is a friction fit between the neck portion 84 of the nylon support/marker member 30 and the cold rolled steel bracket material of the bracket 28 forming the slot portion 42. This friction fit enables the support/marker member 30 to be secured to the bracket 28 without applying an external force on the member 30. Thus, the construction of the support assembly 24 enables the releasable attachment of the support/marker member 30 to the bracket 28. Of course, when employing bracket 54, the operation and manner of use of the bracket 54 with the support/marker member 30 is the same as when employing bracket 28 with the support/marker member.

With particular reference to FIG. 8, the bulbous head 78 of the support/marker member 30 may be formed to have a chamfered or angled surface 86 and an aperture 88 extending from the chamfered or angled surface through the bulbous head 78 and through the base 72. As shown, the aperture 88 extends through the bulbous head 78 and the base 72 along an axis A that is at an angle (e.g., thirty-eight degrees) with respect to an axis B of the base and bulbous head. This construction enables the support/marker member to support the weight of the object being hung, such as the picture frame 10 having the bracket 28 mounted thereon. In one embodiment, the support element 32 may comprise a nail, which is sized to be received within the aperture 88, to secure the support/marker member 30 to the wall 26. Referring to FIG. 9, the nail 32 may be provided with a head 90 to engage the chamfered or angled surface 86 when driving the nail into the wall 26. The nail 32 must be of sufficient length to securely mount the support/marker member 30 to the wall 26.

Referring back to FIG. 1, the support assembly may further comprise a leveling device, generally indicated at 92, adapted to be placed on the object (such as picture frame 10) to indicate an orientation of the object. As shown, the leveling device 92 includes a base portion 94 and a level portion 96 secured to the base portion. The base portion 94 may be provided with an adhesive surface (not shown) to releasably secure the leveling device 92 to the object requiring hanging, e.g., the picture frame 10. The level portion 96 is constructed in the well-known manner, having a cylindrical container with an air pocket that becomes centrally located within the container when the leveling device 96 is in a true, horizontal position. The leveling device 92 is particularly suited for ensuring that rectangular objects, such as picture frames, are mounted on the wall in a horizontal position.

Figure 10:
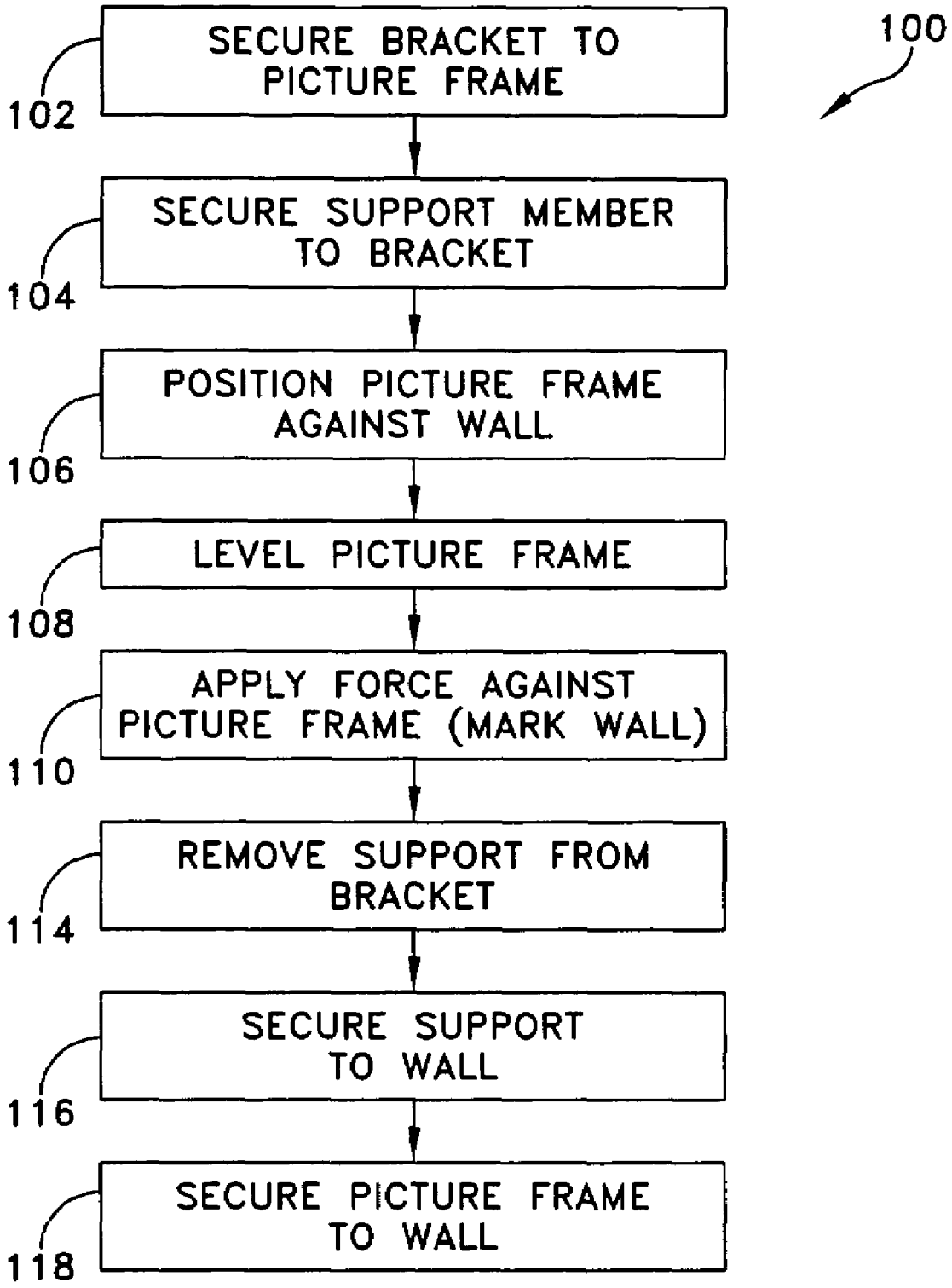
FIG. 10 is a block diagram showing a method of an embodiment of the invention.

The method and manner of using the support assembly 24 to mount an object, such as a picture frame 10, to a structure, such as a wall 26, pursuant to a method 100 shown in FIG. 10 will be described herein using the components of the support assembly 24 shown in FIG. 1, e.g., the bracket 28, the support/marker member 30 and the nail 32. As discussed above, method 100 may be employed to secure any type of object to any type of structure and still fall within the scope of the invention. As shown, at 102, two brackets 28 are secured to the vertical rail members 20, 22 of the frame 12 of the picture frame 10. Specifically, each bracket may be secured to their respective rail member (20 or 22) by the screw fasteners 44. When employing two brackets, it is not critical that they be positioned with respect to one another at exact elevations on their respective rail members. The method 100 of the invention only requires that their respective elevations be approximate to one another so as to provide a strong, solid support of the picture frame 10. Thus, the position of the brackets 28 on their respective rail members 20, 22 may be approximated by the person installing the support assembly 24.

Next, at 104, the support/marker members 30 are releasably secured to the brackets 28 in a position in which the head portions 82 are inserted into the large openings 40 and the neck portions 84 are slid into the slot portions 42. In this position, the bulbous heads 78 are disposed within the spaces 52 defined between the main bodies 34 of the brackets 28 and the rail members of the frame 12 of the picture frame 10. In addition, the marking elements or projections 80 extend away from the picture frame 10. It should be understood that the positioning of the support/marker members 30 within the slot portions 42 of the brackets 28 may take place prior to securing the brackets to the frame 12 of the picture frame 10.

At 106, the picture frame 10 is positioned against the wall 26. When positioning the picture frame 10, the person installing the picture frame on the wall 26 may identify an exact location on the wall by measuring and identifying reference points on the wall, or may position the picture frame by sight. At 108, the picture frame may be leveled with the leveling device 92 so that the top and bottom rail members 16, 18 of the frame 12 of the picture frame 10 are level with respect to a horizontal plane. It should be understood that the provision of employing a leveling device is not critical to performing methods of the invention, but may be provided to achieve a better result.

Figure 11:
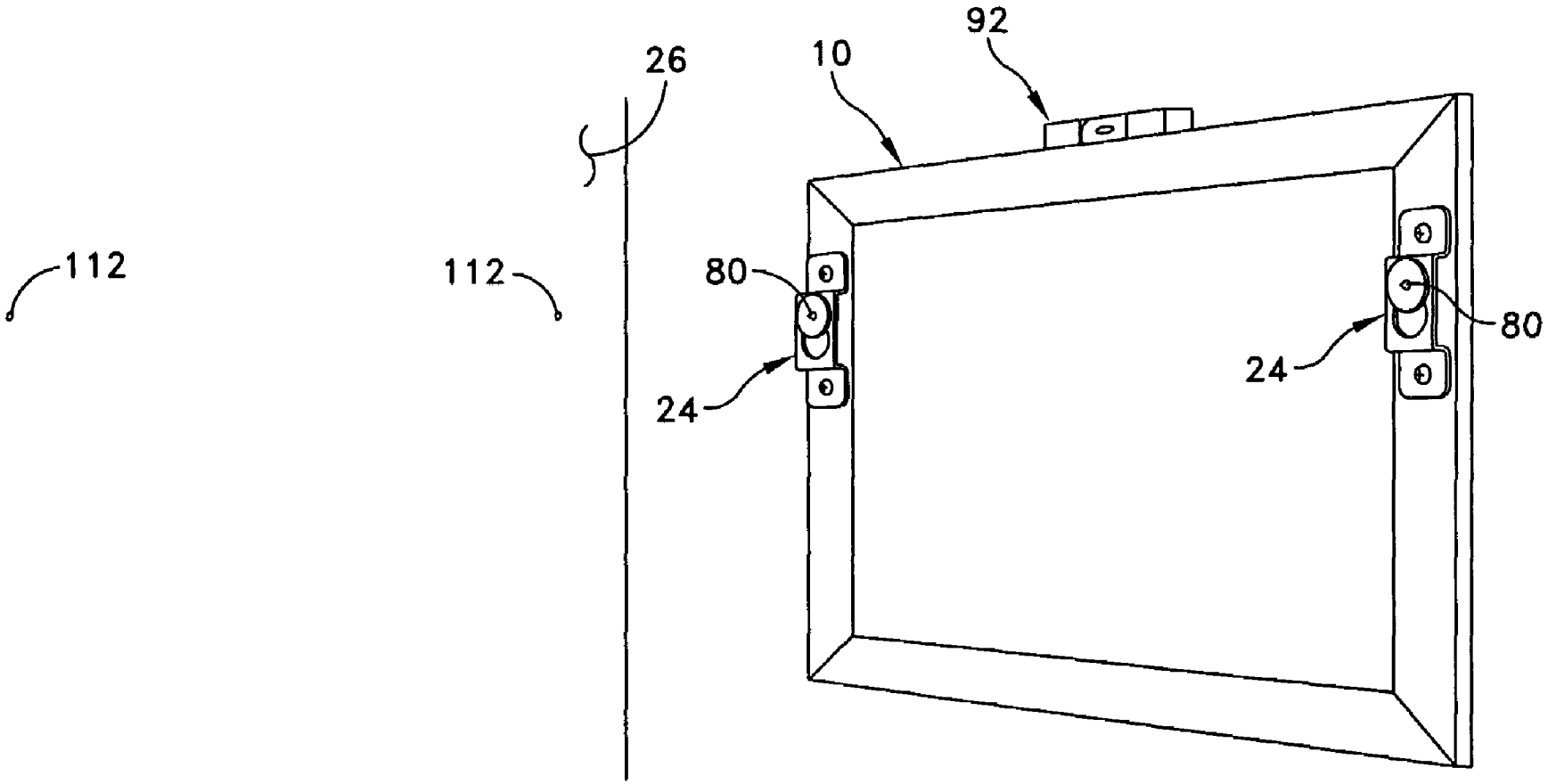
FIG. 11 is a perspective view of the support assemblies after marking a vertical structure with the supports of the support assemblies in accordance with an embodiment of the invention.

Next at 110, and with reference to FIG. 11, a nominal force may be applied against the picture frame 10 so as to mark the wall 26 with the projections 80 provided on the support/marker members 30. As shown in FIG. 11, the projections 80 have pointed tips that are configured to permanently mark the softer material of the wall 26 (e.g., wall board, blue board, sheet rock, plaster, wood, etc.) when employing a sufficient force on the picture frame 10 against the wall. The result is that the projections 80 form indents, each indicated at 112 in FIG. 11, on the wall 26 so as to provide permanent reference points to position the picture frame 10 for hanging. In other embodiments, marking elements, such as pens, pencils, or any other similar implements, may be used to mark the locations of the support/marker members 30 against the wall 26. When using such marking elements, little force is required to mark the wall 26 with the marking element. In addition, due to the design of the support bracket 28, the frame or object will maintain its desired, level position once hung in the manner described below.

At 114, each support/marker member 30 is removed from its respective bracket 28 by sliding the neck portion 84 from the slot portion 42 and removing the head portion 82 from the large opening 40. Once removed, each support/marker member 30 may be secured to the wall 26 by seating the projection 80 within the indent 112 formed in the wall and driving the nail 32 into the aperture 88 of the support/marker member. This step is illustrated at 116 in FIG. 10. For both support/marker members 30, the seating of the projection 80 within the indent 112 ensures that the support/marker member 30 is accurately positioned on the wall 26. Thus, when hanging the picture frame, the installer is ensured that the picture frame will be positioned on the wall in the exact, desired position. With other marking elements (e.g., pens), the marking element may require positioning against the mark prior to securing the support/marker member 30 with the securing element 32 on the wall 26.

Once secured to the wall 26, at 118, the picture frame 10 may be mounted on the wall by securing the bracket 28 to the support/marker member 30. Specifically, for each support assembly 24, the head portion 82 is inserted into the large opening 40 and the neck portion 84 is slid into the slot portion 42. In this position, the support/marker members 30 support the weight of the picture frame 10 in a secure manner. The head portions 82 prevent movement of the picture frame 10 away from the wall 26. It should be noted that since the support/marker members 30 are positioned on the wall 26 an identical distance apart from each other as the brackets 28 on the frame 12 of the picture frame 10, the brackets of the picture frame slide easily over the support/marker members for mounting.

As discussed above, methods of embodiments of the invention may be used to mount or otherwise hang or suspend any type of object onto any type of structure. For example, mirrors, shelves, objects of art, etc., may be secured using the teachings provided herein. In addition, the objects may be hung on walls other than vertical walls, such as walls that are inclined.

The support assembly 24 discussed herein may be provided in the form of a kit designed to provide an installer the necessary components used to secure an object, such as a picture frame, to a structure, such as a wall. Such a kit may include a bracket adapted to be secured to the object, a support/marker member, a securing element, such as a nail, and optionally a leveling device provided to level the object being hung or supported. In other embodiments, the kit may include two brackets, two support/marker members, two nails and a single leveling device. Such a kit would be particularly suited for securing a picture frame to a wall, for example. Individual components may also be provided in bulk form suitable for other markets.

FIGS. 12-19 illustrate an embodiment of the invention particularly suited for mounting an object, such as a picture frame, on a wall in a secure position to prevent the unwanted taking or theft of the object. This embodiment may be particularly directed to situations in which the installer or owner wants to permanently secure artwork to the wall, such as in hotels, restaurants and related venues.

Figure 12:
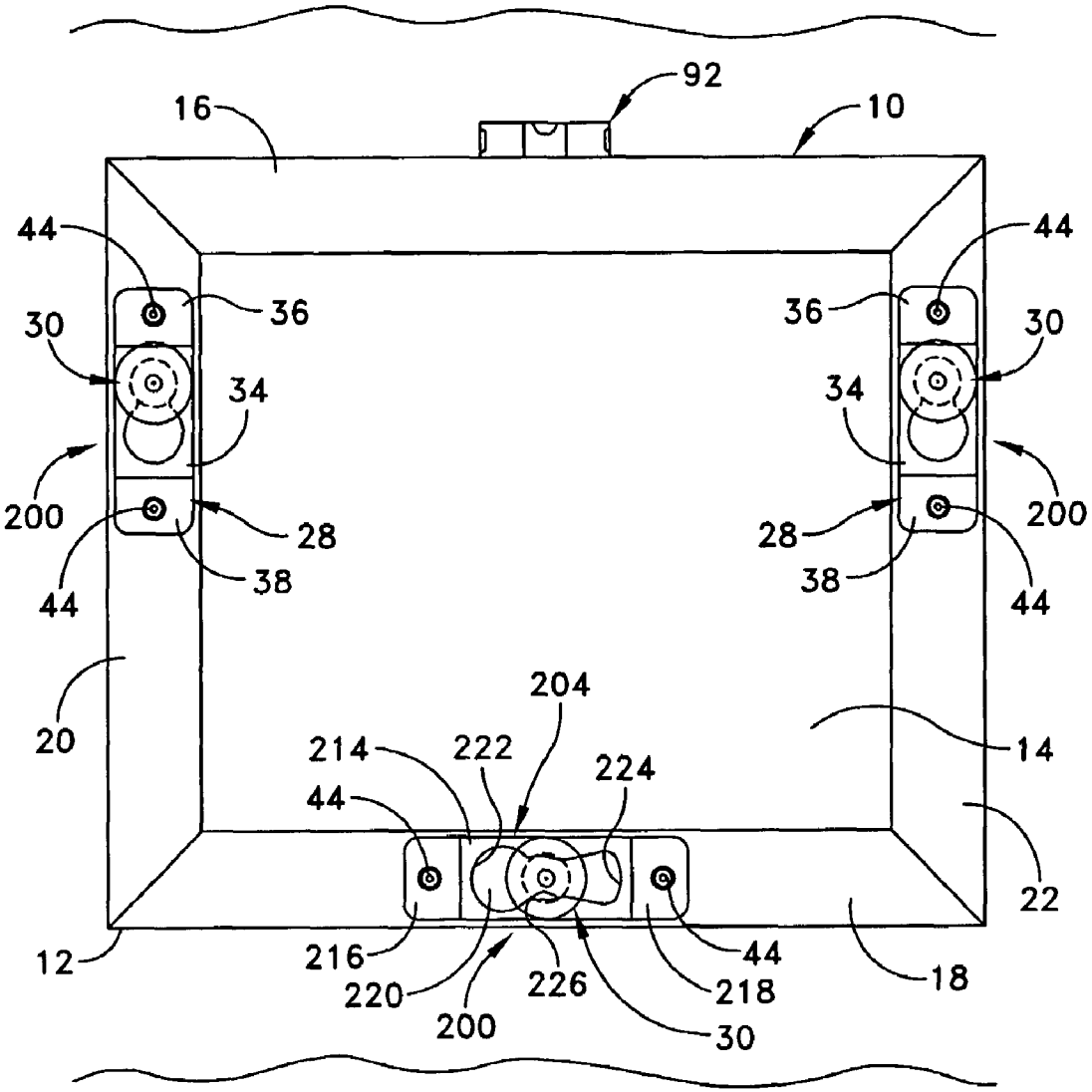
FIG. 12 is a rear view of a picture frame having support assemblies of another embodiment of the invention.

Referring particularly to FIG. 12, a picture frame 10 is shown having three support assemblies, each generally indicated at 200, with two support assemblies 200 being positioned on the two vertical rail members 20, 22 and the third support assembly 200 being positioned on the lower rail member 18 of the picture frame 10. For each support assembly 200 mounted on the vertical rail members 20, 22, the support assembly may initially include the bracket 28 as described above and a support/marker member 30. As with support assembly 24, the bracket 28 of each support assembly 200 may be secured to the picture frame 10 by screw fasteners 44. The support assembly 200 provided on the lower rail member 18 of the picture frame 10 may initially include a bracket, generally indicated at 204, and a support/marker member 30. As described above, the support/marker members 30 may be configured to be releasably secured to their respective brackets 28, 204 in the same manner as the support/marker member 30 is secured to the bracket 28. The support assembly 200 is configured to replace the support/marker members 30 so as to provide the security feature of this particular embodiment of the invention. As shown in FIG. 12, a leveling device 92 may be further provided to level the picture frame 10 in accordance with the description provided for the support assembly 24 described above.

Figure 13:
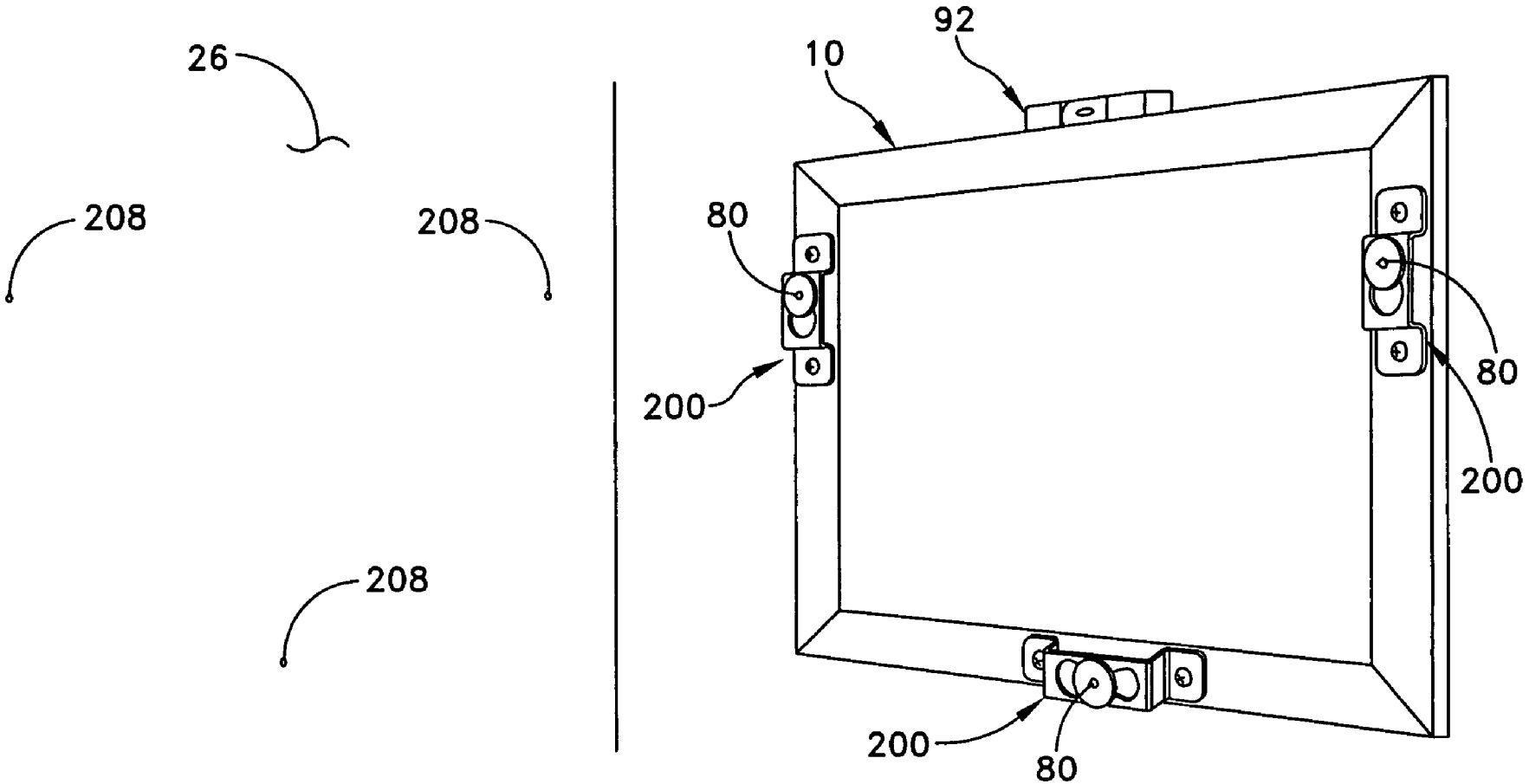
FIG. 13 is a perspective view of the support assemblies illustrated in FIG. 12 after marking a vertical structure with supports of the support assemblies in accordance with an embodiment of the invention.

As shown in FIG. 13, the support/marker members 30, when positioned within their respective brackets 28, 204, are provided with projections 80 so that the application of a nominal force applied against the picture frame 10 will mark the wall 26. As shown in FIG. 13, the projections 80 have pointed tips that are configured to permanently mark the softer material of the wall 26 when employing a sufficient force on the picture frame 10 against the wall. The result is that the projections 80 form indents, each indicated at 208 in FIG. 13, on the wall 26 so as to provide permanent reference points to position the picture frame 10 for hanging. As with prior embodiments of the invention, other marking elements, such as pens, pencils, or any other similar implements, may be used to mark the locations of the support/marker members 30 against the wall 26. When using such marking elements, little force is required to mark the wall 26 with the marking element. As shown, three such reference points 208 result after applying a marking force on the picture frame 10.

Figure 14:
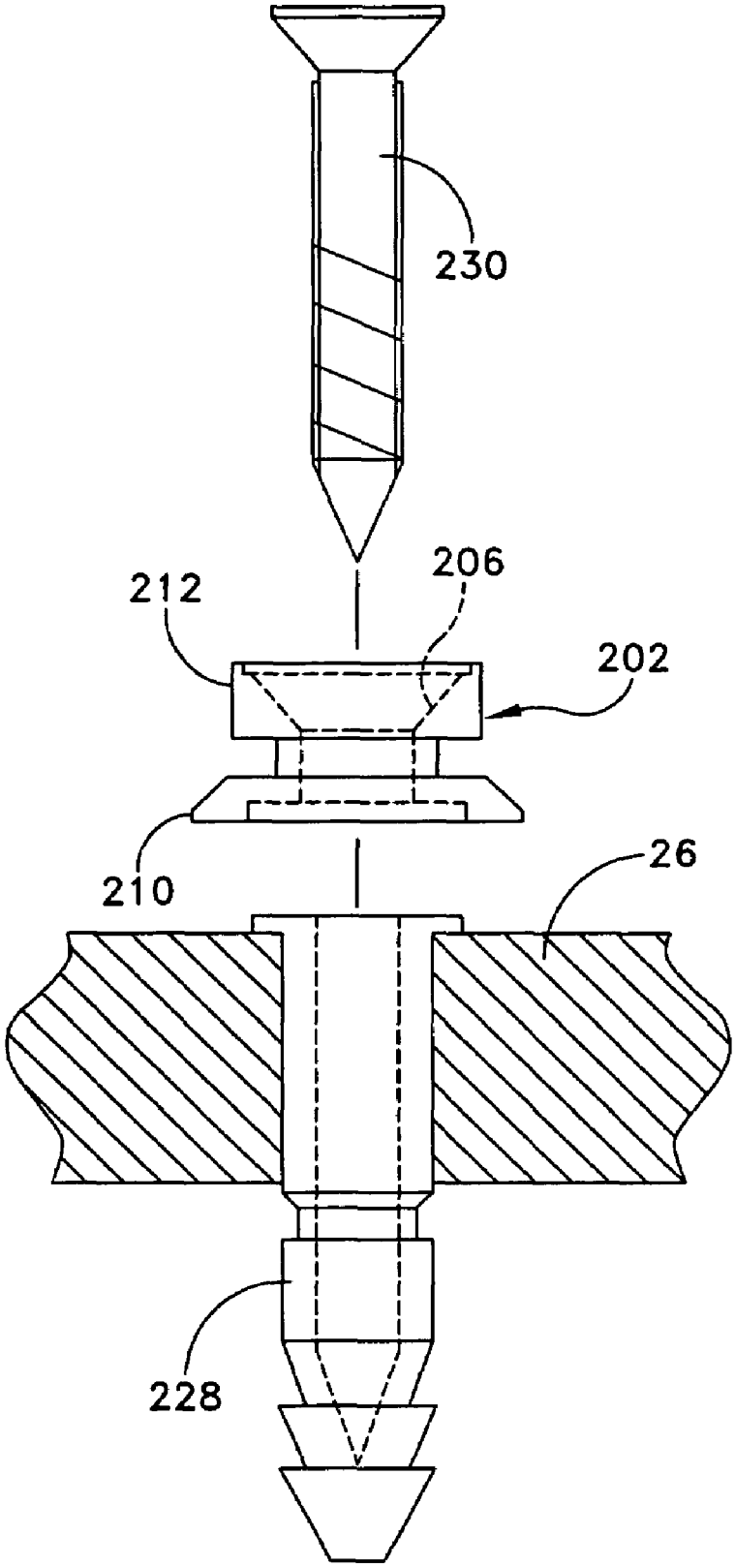
FIG. 14 is an enlarged, exploded, partial cross-sectional view of a support of one of the support assemblies illustrated in FIG. 12 being mounted on the vertical structure.

Once the wall 26 is marked by the support/marker members 30, the two members 30 associated with the two vertical rail members 20, 22 may be replaced with substitute support members. FIG. 14 illustrates such a support member, which is generally indicated at 202. As with support/marker member 30, the support member 202 may be fabricated from plastic material, such as nylon. As shown in FIG. 14, the support member 202 may include a base 210 and a bulbous head 212 extending from one side of the base. With particular reference to bracket 28, the arrangement is such that the support member 202 may be releasably secured to the bracket 28 by simply inserting the bulbous head 212 into the large opening 40 and sliding the bulbous head into the slot portion 42. This configuration is the same as employing the support/marker members 30 discussed above.

With bracket 204, the bracket may include a main body 214 and a pair of tabs with one tab 216 provided on one side of the main body and another tab 218 provided on the other side of the main body. As with bracket 28, the main body 214 is offset with respect to the tabs 216, 218 so as to provide a space between the main body and the frame 12 of the picture frame 10 when mounting the bracket 204 onto the picture frame. As shown best in FIG. 12, the main body 214 includes an elongate opening 220 having at its opposite ends a circular portion 222 and a portion 224 connected to one another by a narrow portion 226. The support/marker member 30 and the support member 202 are configured to be seated within the narrow portion 226 when marking the wall 26. The purpose of the elongate opening 220 of bracket 204 will become apparent as the description proceeds.

Turning to FIG. 14, after marking the wall 26 with the support/marker members 30, with respect to the two brackets 28 located on the rail members 20, 22, the substitute support members 202 may be secured to the wall 26, such as a sheet rock or dry wall material, by employing a wall insert 228 and a screw fastener 230 configured to be threadably inserted into the wall insert. In one embodiment, the wall insert 228 is secured in place by drilling a hole in the wall 26 at the location of the indent 208 and position the wall insert within the hole. The wall insert 228 is not required when securing the support member 202 in a harder material, such as wood. As shown in FIG. 14, the support member 202 is configured with an axial bore 206 designed to receive a pan head fastener 230 therein to secure the support member 202 in place. This arrangement provides a more secure attachment of the support member 202 to the wall 26 than the arrangement used with support/ marker member 30, e.g., the nail 32. With respect to the one bracket 204 located on the lower rail member 18, a "T" head screw fastener 232 is provided to secure the support member 202 in place. In a certain embodiment, the T head screw fastener 232 has a rectangular shape that is configured to fit within the narrow portion 226 of the bracket 204 and rotated ninety degrees to secure the fastener 230 to the bracket 204. Specifically, the T head screw fastener 232 includes a threaded portion 234, which may also be threadably attached to insert 228, a shoulder portion 236 and a rectangular-shaped head 238 that is sized to fit within the narrow portion 226 of the bracket 204.

Figure 15:
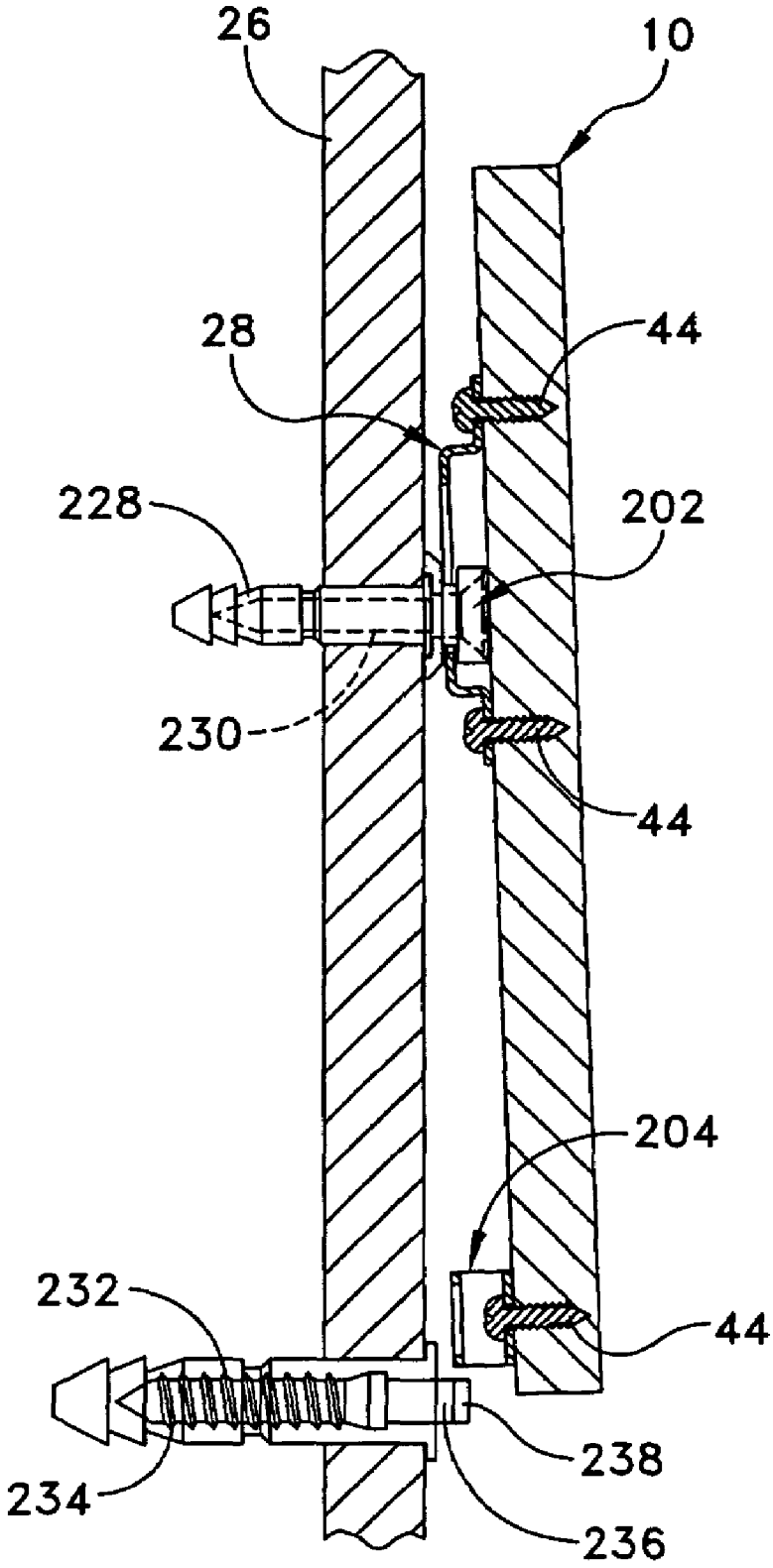
FIG. 15 is a cross-sectional view of the picture frame partially engaged to a wall with two of the support assemblies shown in FIG. 12.
Figure 16:
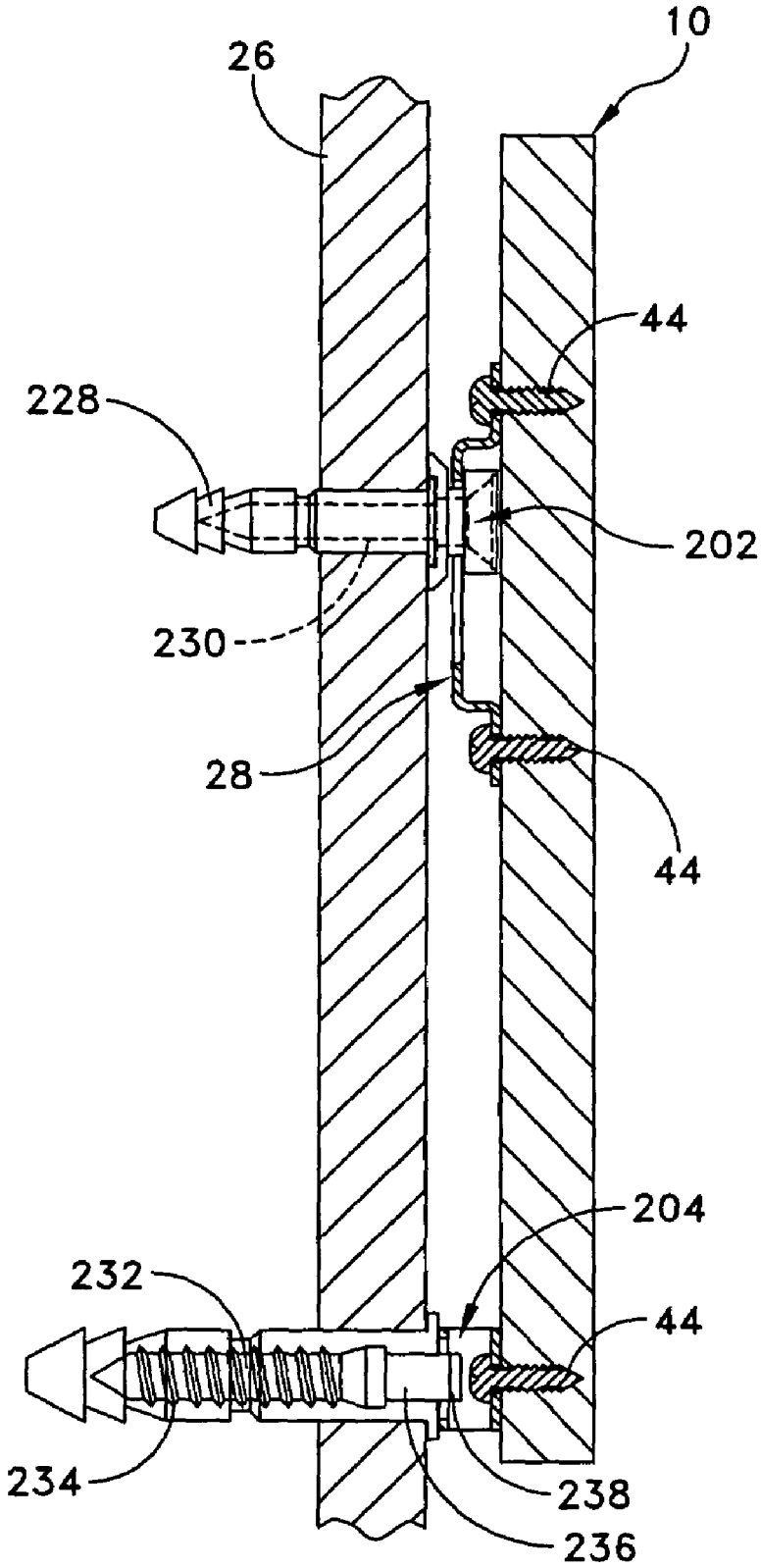
FIG. 16 is a cross-sectional view similar to FIG. 15 illustrating the insertion of one of the supports within a slot of a bracket.

FIGS. 15-18 illustrate the sequence of operation to install the picture frame 10 on the support members 202 and the fastener 232 in a secure manner. With reference to FIG. 15, the picture frame 10 may be mounted on the wall 26 by securing the brackets 28 to the support members 202 with the rectangular head 238 of fastener 232 in a horizontal position. Specifically, the bulbous heads 212 of the support members 202 are inserted into the large openings 40 of the brackets 28 and are slid into the slot portions 42. Concurrent with this motion, the rectangular head 238 of the fastener 232 is inserted into the narrow portion 226 of the elongate opening 220 and is thereby disposed within the space defined by the main body 214 and the frame 12 of the picture frame 10. In this position, the support members 202 support the weight of the picture frame 10. This position is illustrated in FIG. 16.

Figure 17:
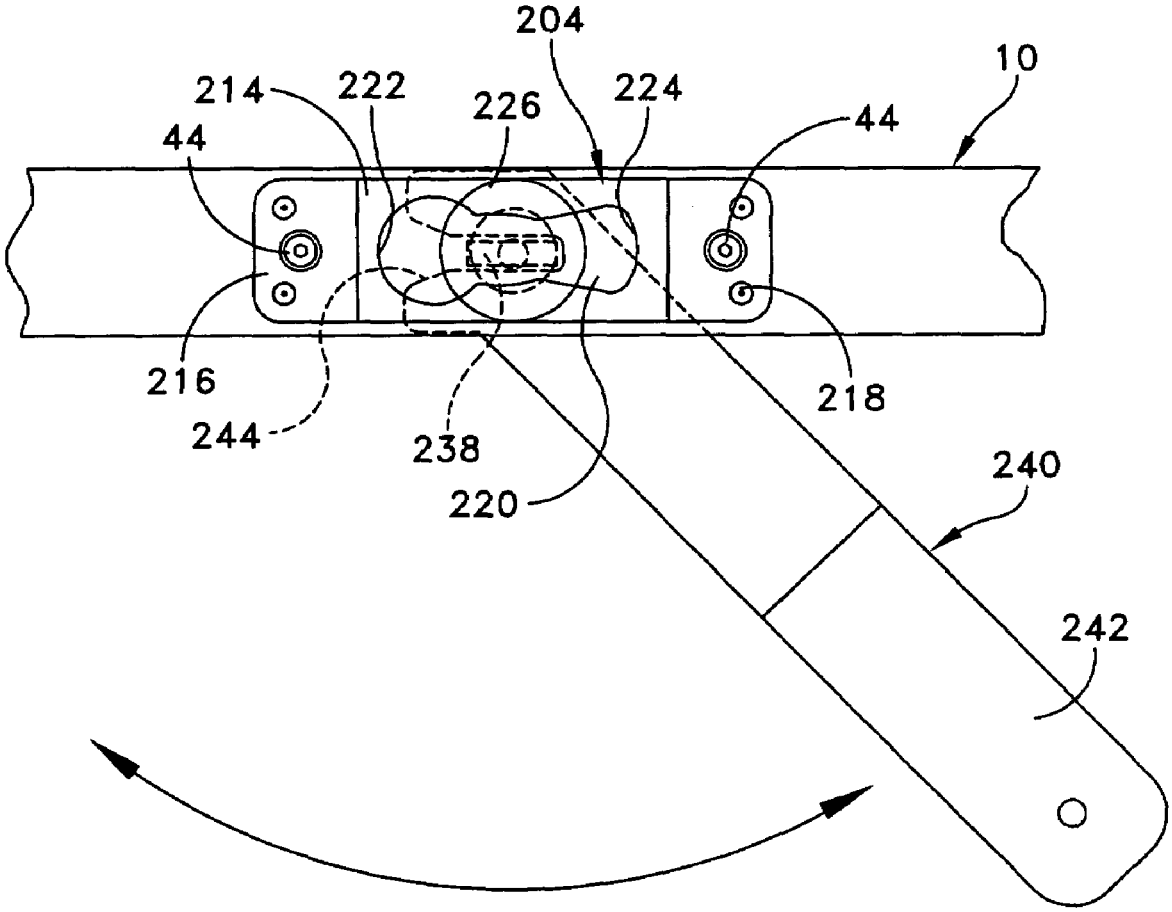
FIG. 17 is a rear view of one of the support assemblies.
Figure 18:
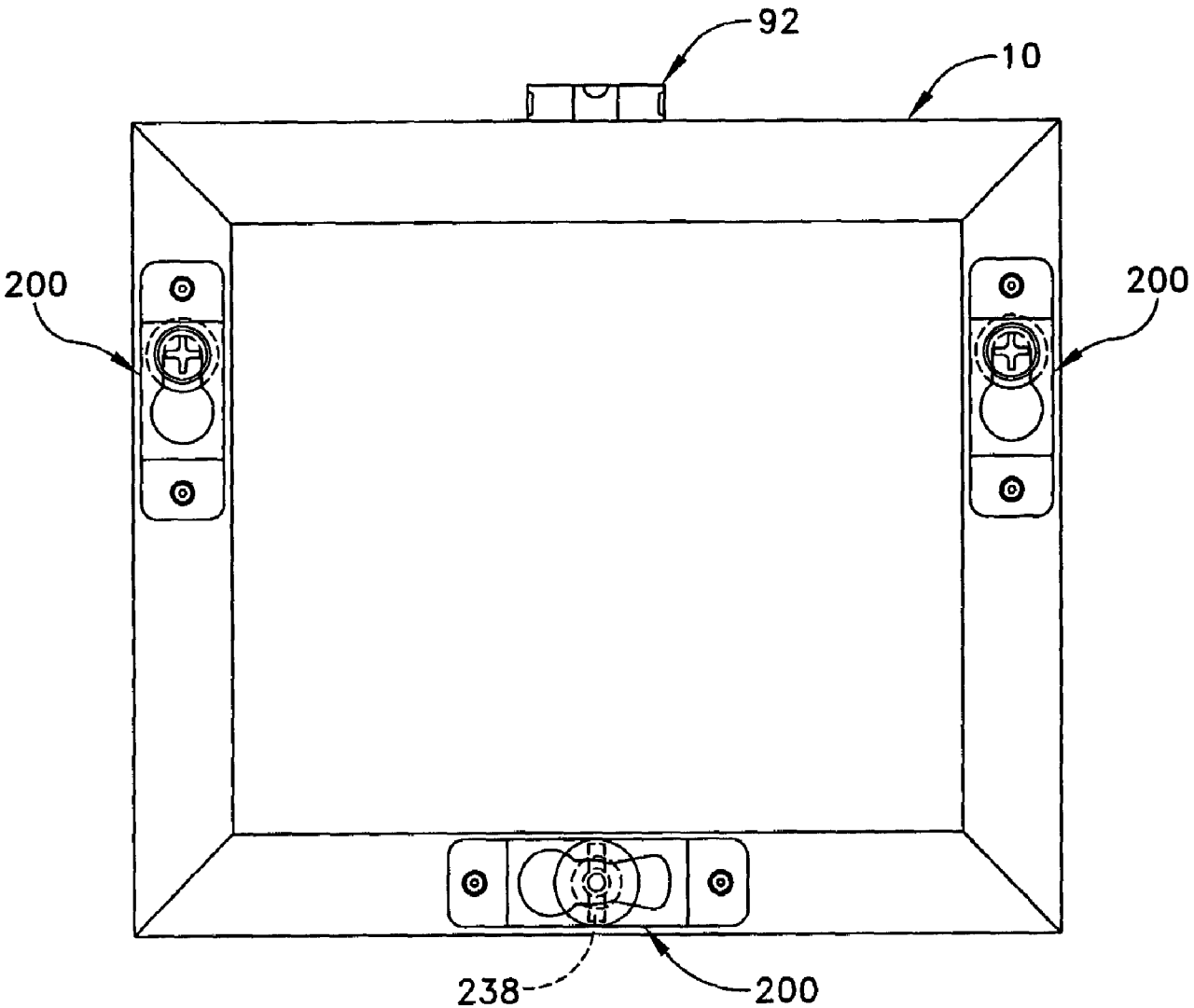
FIG. 18 is a rear view of the picture frame shown in FIG. 12 in a secured position.

Once positioned, the shoulder portion 236 may be rotated ninety degrees from its shown horizontal position in FIG. 16 to a vertical position by use of a tool 240, which is illustrated in FIG. 17. The tool 240 includes a handle portion 242 and slot portion 244 designed to engage the shoulder portion 236 in a manner sufficient to rotate or otherwise turn the fastener 232. Once rotated, the rectangular head 238 of the fastener 232 engages the bracket 204 to prevent the movement of the fastener 232 from the bracket 204 so as to permanently secure the picture frame 10 to the wall 26 until such time the shoulder portion 236 is rotated another ninety degrees so as to enable the picture frame to be removed. FIG. 18 illustrates the picture frame 10 in a secure position with the rectangular head 238 of the fastener 232 in a vertical position.

Figure 19:
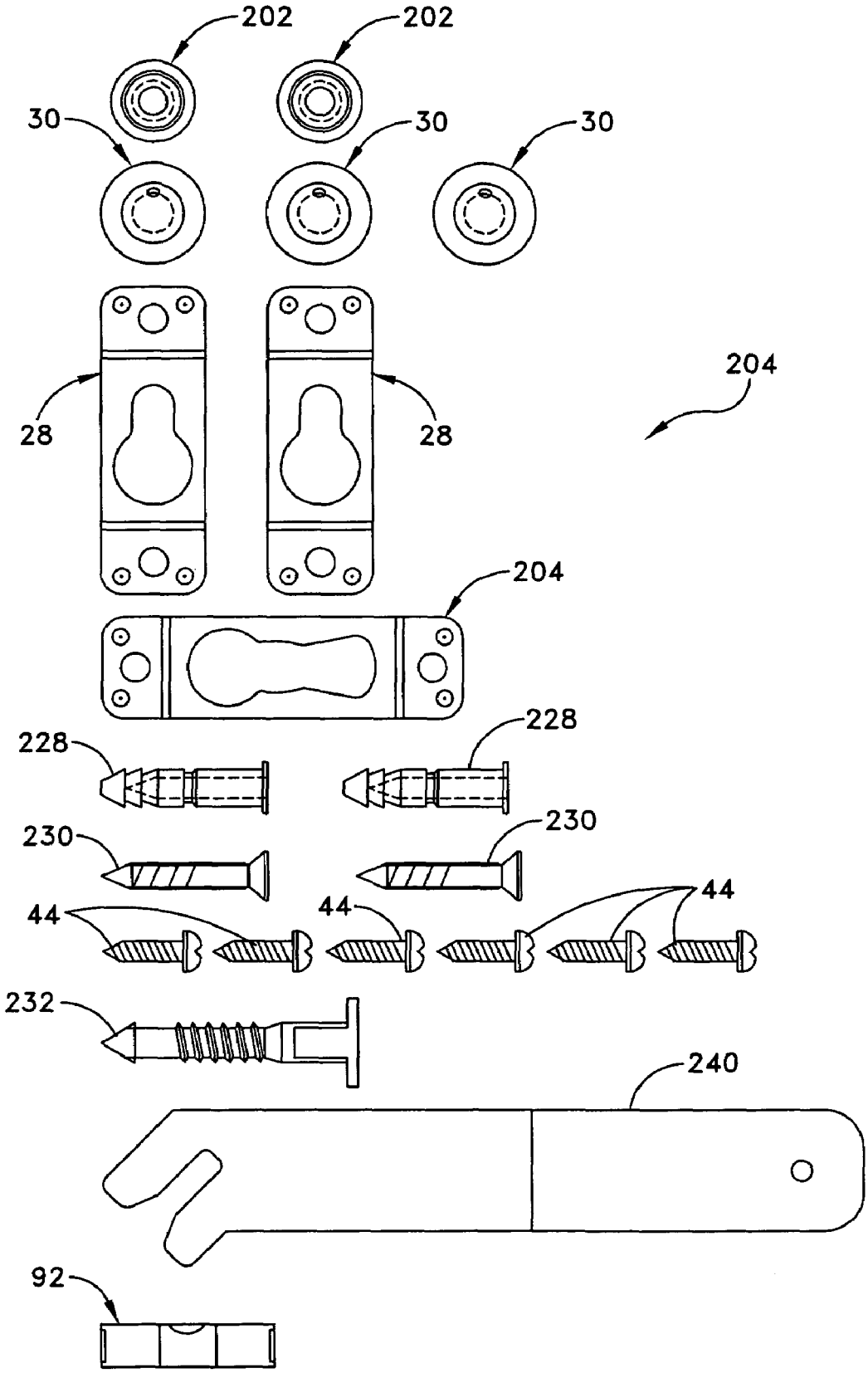
FIG. 19 is a view showing a kit of an embodiment of the invention.

Referring to FIG. 19, a kit, generally indicated at 244, is provided to secure an object, such as a picture frame, to a structure, such as a wall, in the manner described with reference to FIGS. 12-18. As shown, the kit includes two support members 202, three support/marker members 30, two brackets 28, one bracket 204, at least two and preferably three inserts 228, two screw fasteners 230, six screw fasteners 44, one fastener 232, one tool 240, and one level 92. With these components, the kit 244 may be employed to mount the object onto the structure in a secure, theft-resistant manner.

Thus, it should be observed that embodiments of the support assemblies and methods disclosed herein are particularly suited for hanging an object, such as a picture frame, in an exact location on a structure, such as a wall. The projection provided on each support/marker member enables the installer to simply press the picture frame against the wall to mark the location of the support/marker member on the wall with an indentation formed in the wall. The resultant is that the picture frame is hung in the exact location desired by the person installing the picture frame since the projections are seated within the indents formed in the wall. The interconnection of the support/marker member to the bracket provides a solid support of the picture frame and is therefore resistant to vibration or sudden jarring that may cause the picture frame to be displaced. This mounting system may be considered a safer installation, especially around children, as the system allows for an object to be more securely mounted on a wall. The "wireless" nature of the mounting system eliminates a commonly used component in the wall décor and art industry, i.e., the wire, which increases the overall safeness of the system. Components of the support assembly are inexpensive to manufacture and may be provided in the form of a kit that is sold to an installer at a hardware store or a home improvement retail center, for example.

Embodiments of the bracket and the support/marker member may include components of any shape or size that are constructed of any suitable material. The support/marker members may be configured for use with any type of bracket. For example, although a bulbous head and keyhole opening configuration is shown and described herein, the support/marker element may be configured to be releasably attached to the bracket in any suitable manner, such as by employing magnetic materials, hook and loop fastener materials, adhesives, snap-fit arrangements and any other securing techniques. Additionally, the marking device, i.e., the projection, may be configured in any suitable manner so as to accurately position the support/marker member on the wall. For example, marking may be implemented by any suitable implement or instrument, including a pin, a spike, a pen, a pencil and a marker.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A support assembly configured to secure an object to a structure, the support assembly comprising:

a bracket adapted to be secured to the object, the bracket having an opening formed therein;

a support adapted to be received within the opening of the bracket in a secure position, the support having a marking element designed to extend away from the object when positioning the support within the opening of the bracket, the arrangement being such that when positioning the support within the opening of the bracket, the marking element is adapted to form a mark on the structure in response to positioning the object against the structure; and a device adapted to secure the support to the structure upon removing the support from the opening of the bracket with the marking element being positioned on the mark formed on the structure, wherein the support secures the object to the structure upon positioning the object on the support in a position in which the support is received within the opening of the bracket.

2. The support assembly of claim 1, wherein the support further has a base having opposite sides, the marking element extending from one side of the base.

3. The support assembly of claim 2, wherein the support further has a head portion extending from an other side of the base, the head portion being adapted to be received within the opening of the bracket.

4. The support assembly of claim 3, wherein the opening of the bracket is configured to have a first portion configured to receive the head portion and a second portion in communication with the first portion configured to receive a neck portion of the support therein when positioning the support within the opening.

5. The support assembly of claim 4, wherein the bracket has at least one tab adapted to secure the bracket to the object.

6. The support assembly of claim 5, wherein the bracket further has a main body having the opening, the main body and the at least one tab defining a space between the bracket and the object when securing the bracket to the object.

7. The support assembly of claim 3, wherein the head portion of the support has a surface and an aperture extending from the surface through the base for receiving the device therein.

8. The support assembly of claim 7, wherein the device comprises a nail that is sized to be received within the aperture.

9. The support assembly of claim 1, wherein the marking element comprises a projection having a pointed tip.

10. The support assembly of claim 1, further comprising a leveling device adapted to be placed on the object to indicate an orientation of the object.

11. The support assembly of claim 1, further comprising a fastener configured to replace the support and to mount on the structure to secure the bracket to the structure.

12. The support assembly of claim 11, wherein the fastener comprises a T head screw fastener.

13. A method of securing an object to a structure, the method comprising:

securing a bracket to the object;

releasably securing a support to the bracket, the support having a marking element designed to extend away from the object;

positioning the object against the structure;

applying a force on the object against the structure so as to form a mark on the structure with the marking element;

removing the support from the bracket;

securing the support to the structure with the marking element being positioned on the mark formed on the structure; and securing the object to the structure by securing the bracket to the support.

14. The method of claim 13, wherein securing the support to the bracket comprises positioning the support within an opening formed in the bracket.

15. The method of claim 14, wherein securing the object to the structure comprises positioning the support within the opening of the bracket.

16. The method of claim 14, wherein the marking element is a projection having a pointed tip, and wherein the mark is an indent formed on the structure.

17. The method of claim 16, wherein securing the support to the structure comprises seating the projection within the indent.

18. The method of claim 13, further comprising leveling the object prior to applying a force on the object.

19. The method of claim 13, further comprising replacing the support with a fastener, and rotating the fastener with respect to the bracket.

20. A kit for securing an object to a structure, the kit comprising:

a first support element adapted to be secured to the object;

a second support element adapted to be secured to the first support element, the second support element having a marking element designed to extend away from the object when securing the second support element to the first support element, the arrangement being such that when securing the second support element to the first support element, the marking element is adapted to form a mark on the structure at a desired location on the structure in response to a force applied on the object; and a device adapted to secure the second support element to the structure upon removing the second support element from the first support element with the marking element being positioned on the mark formed on the structure;

wherein the second support element secures the object to the structure upon positioning the object on the second support element.

21. The kit of claim 20, wherein the first support element is a bracket, and wherein the second support element is a support.

22. The kit of claim 20, wherein the device comprises a nail.

23. The kit of claim 20, wherein the object is a picture frame and the structure is a wall.

24. The kit of claim 20, further comprising a leveling device adapted to be placed on the object to indicate an orientation of the object.

25. The kit of claim 20, further comprising a third support element configured to replace the second support element to provide tamper-proof attachment to the first support element.

26. The kit of claim 25, further comprising a tool to rotate the third support element.

27. A support assembly configured to secure an object to a structure, the support assembly comprising:

a bracket adapted to be secured to the object;

a support adapted to be releasably secured to the bracket, the support having a marking element designed to extend away from the object when releasably securing the support to the bracket, the arrangement being such that when releasably securing the support to the bracket, the marking element is adapted to form a mark on the structure on the structure in response to positioning the object against the structure; and a device adapted to secure the support to the structure upon removing the support from the opening of the bracket with the marking element being positioned on the mark formed on the structure, wherein the support secures the object to the structure upon positioning the object on the support in a position in which the support is releasably secured to the bracket.

28. The support assembly of claim 27, wherein the bracket has an opening formed therein configured to receive the support in a releasably secure position.

29. The support assembly of claim 27, wherein the support further has a base having opposite sides, the marking element extending from one side of the base.

30. The support assembly of claim 29, wherein the support further has a bulbous head extending from an other side of the base, the bulbous head being adapted to be received within the opening of the bracket.

31. The support assembly of claim 30, wherein the opening of the bracket is configured to have a first portion configured to receive the bulbous head and a second portion in communication with the first portion configured to receive a neck of the bulbous head therein when positioning the support within the opening.

32. The support assembly of claim 31, wherein the bracket has at least one tab adapted to secure the bracket to the object.

33. The support assembly of claim 32, wherein the bracket further has a main body having the opening, the main body defining a space between the bracket and the object when securing the bracket to the object.

34. The support assembly of claim 30, wherein the bulbous head of the support has a surface and an aperture extending from the surface through the base, the aperture being configured to receive the device therein.

35. The support assembly of claim 27, wherein the object is a picture frame and the structure is a wall.

36. The support assembly of claim 27, further comprising a leveling device adapted to be placed on the object to indicate an orientation of the object.

37. A method of securing an object to a structure, the method comprising:

securing a first support element to the object;

releasably securing a second support element to the first support element, the second support element having a projection designed to extend away from the object;

positioning the object against the structure;

applying a force on the object so as to form an indent on the structure with the projection of the second support element;

removing the second support element from the first support element;

seating the projection of the second support element within the indent of the structure;

securing the second support element to the structure; and securing the object to the structure by securing the first support element to the second support element.

38. The method of claim 37, further comprising replacing the support with a fastener, and rotating the fastener with respect to the bracket.

* * * * *